US007475447B2

(12) United States Patent
Vila Corts

(10) Patent No.: US 7,475,447 B2
(45) Date of Patent: Jan. 13, 2009

(54) SWIMMING POOL BOTTOM CLEANING DEVICE

(75) Inventor: Francesc Xavier Vila Corts, Barcelona (ES)

(73) Assignee: Inversiones Deloscua, S.L., Barcelona (ES)

( * ) Notice: Subject to any disclaimer, the term of this patent is extended or adjusted under 35 U.S.C. 154(b) by 0 days.

(21) Appl. No.: 11/450,201

(22) Filed: Jun. 9, 2006

(65) Prior Publication Data

US 2007/0017045 A1 Jan. 25, 2007

(30) Foreign Application Priority Data

Jun. 16, 2005 (ES) ..... 200501388 U

(51) Int. Cl.
*E04H 4/16* (2006.01)

(52) U.S. Cl. ..... 15/1.7

(58) Field of Classification Search ..... 15/1.7
See application file for complete search history.

(56) References Cited

U.S. PATENT DOCUMENTS

| | | | | |
|---|---|---|---|---|
| 4,761,848 | A * | 8/1988 | Hofmann | 15/1.7 |
| 4,817,225 | A * | 4/1989 | Stoltz | 15/1.7 |
| 5,301,380 | A * | 4/1994 | Wadman et al. | 15/1.7 |
| 5,317,777 | A * | 6/1994 | Stoltz | 15/1.7 |
| 5,418,995 | A * | 5/1995 | Rice et al. | 15/1.7 |
| 5,617,606 | A * | 4/1997 | Scott et al. | 15/246 |
| 5,634,229 | A * | 6/1997 | Stoltz | 15/1.7 |
| 6,473,928 | B1 * | 11/2002 | Veloskey et al. | 15/1.7 |
| 6,966,092 | B2 * | 11/2005 | Sebor | 15/1.7 |

FOREIGN PATENT DOCUMENTS

| | | | |
|---|---|---|---|
| EP | 0 745 744 | A1 | 12/1996 |
| EP | 1 734 207 | A2 | 12/2006 |
| EP | 1 734 207 | A3 | 8/2007 |
| GB | 2 182 551 | A | 5/1987 |
| WO | WO 02/01022 | A1 | 6/2001 |

* cited by examiner

*Primary Examiner*—Randall Chin
(74) *Attorney, Agent, or Firm*—Merchant & Gould P.C.

(57) ABSTRACT

A swimming pool bottom cleaning device includes a cleaning head (1) fitted with an alternately suctioning valve arrangement and provided with an elastic sliding base (2) being freely rotatable in its plane. The valve arrangement includes a freely moving, ball-shaped valve member (3) and a second valve member being formed by a piston (6) with a Venturi arrangement. These two valve members are related to each other by an articulated shaft (9 and 10) and are thus fit to alternately act on the main suction pipe (5) and on the tubular attachment (7) being laterally connected to the main pipe. The sliding base (2) has a generally triangular shape as well as transversal folds (14) being provided in the coma regions (13) and an upwardly extending skirt (15) being provided around its periphery.

3 Claims, 2 Drawing Sheets

SWIMMING POOL BOTTOM CLEANING DEVICE

BACKGROUND OF THE INVENTION

As is known, swimming pools require a periodical cleaning mainly of their bottoms, and said cleaning can be carried out either manually, which entails the need to carry out a hard and unpleasant work, or by using some of the commercially available devices allowing to automatically carry out said cleaning operation.

These cleaning devices generally comprise a cleaning head being provided with an alternately suctioning valve arrangement being fit to bring about the motion of the device on the swimming pool bottom, these devices having an elastic base being freely rotatable in its plane and thus allowing them to move around, said base hence acting as a by way of deflector.

Most of these cleaning devices have a complex valve makeup increasing their cost, and besides they only allow to obtain a poor cleaning result due to a maloperation while moving around on the swimming pool bottom.

SUMMARY OF THE INVENTION

This invention has as its object a cleaning device being fit to improve the performance of the known devices, said cleaning device for such a purpose having been provided with a simplified valve arrangement and with a sliding base allowing the device to travel through the different regions of the swimming pool bottom thereby clearing the obstacles and adapting to the bottom's shape.

As a characterizing feature the valve arrangement for such a purpose comprises a freely moving, ball-shaped valve member acting on the lower open end of the main suction pipe, and a valve member being formed by a piston with a Venturi arrangement which acts on a tubular attachment being laterally connected to the main pipe, these two valve members being related to each other by means of an articulated shaft and acting in an alternate manner.

A further feature of this device lies in the makeup of the sliding base as per a generally triangular shape in its plan-view, said base being provided with transversal folds in the corner regions and having an upwardly extending skirt around its periphery, the base being hence fit to easily turn and bend so as not to get stuck in front of the accessories or obstacles being possibly present on the swimming pool bottom.

These and other characterizing features will be best made apparent by the following detailed description whose understanding will be made easier by the two accompanying sheets of drawings showing a practical embodiment being cited only by way of example not limiting the scope of the present invention.

DETAILED DESCRIPTION

Figure 1:
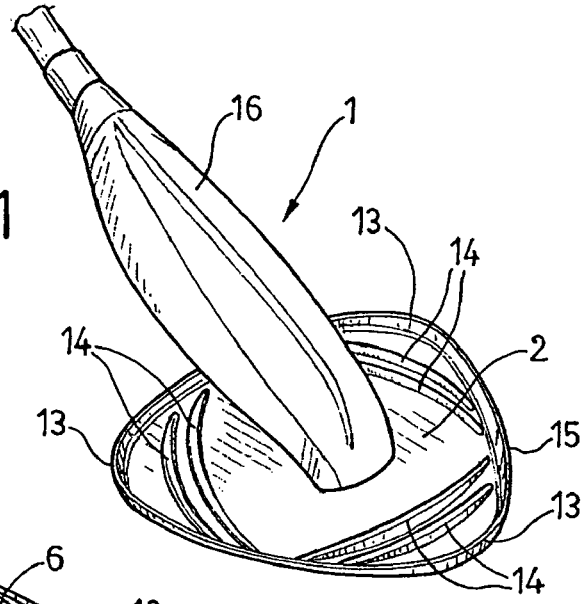
FIG. 1 is a perspective view of the cleaning head being comprised by the cleaning device being the object of the present invention.

According to the drawings this swimming pool bottom cleaning device comprises a cleaning head (1) being provided with a valve arrangement and having a sliding base (2).

The valve arrangement in a lower arrangement comprises a valve member being made up by a ball (3) being designed for closing the lower open end (4) of the main suction pipe (5); and in an upper arrangement the valve arrangement comprises another valve member being formed by a piston (6) acting on a tubular attachment (7) being connected to a lateral opening (8) of the main pipe (5), a Venturi arrangement being thus formed.

The ball (3) and the piston (6) are related to each other by means of a shaft being formed by two portions (9) and (10) being mutually linked in a pin-jointed connection, the portion (9) being in its turn linked in a pin-jointed connection to a fixed point (11) being provided at the periphery of the chamber (12) housing the ball (3).

The sliding base (2) having an elastic makeup has a generally triangular shape in its plan-view and in the region of its radiused corners (13) comprises transversal folds (14), said sliding base also comprising an upwardly extending skirt (15) around its periphery and thus acting as a deflector.

The cleaning device is completed with a cover (16) of the main body (17) of the cleaning head.

Figure 4:
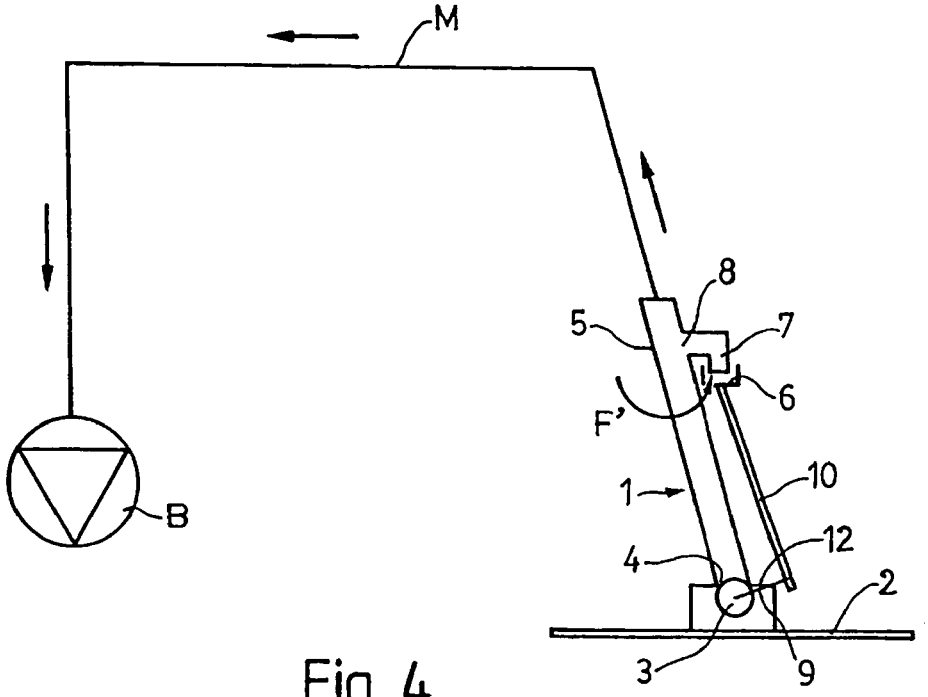
FIGS. 4 and 5 diagrammatically illustrate the operation of the device as per the valve obturation according to FIGS. 2 and 3, respectively.
Figure 5:
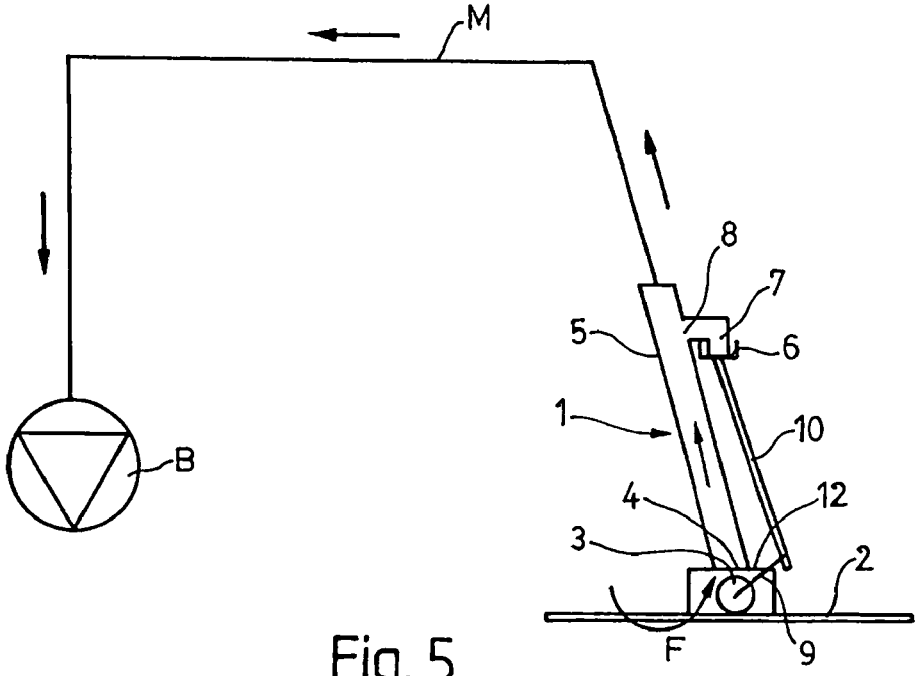

The operational principle of this device is based on a hydraulic pump (B) being operable for suctioning the swimming pool water through flexible hoses (M) (FIGS. 4 and 5).

Figure 3:
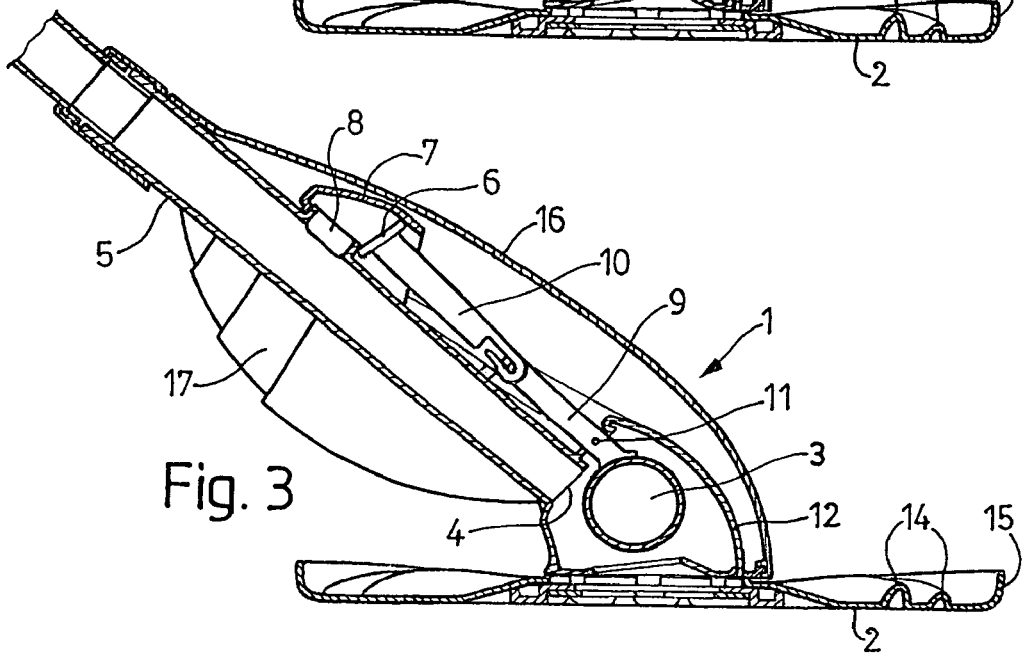

The mechanical valve arrangement makes up a bypass for the suctioned water as per a flowpath alternately switching between the ball (3) and the piston (6) through the shaft (9, 10), the arrangement being what causes the motion of the device and the suction of the dirt having gathered on the swimming pool bottom. This arrangement is fit to carry out two alternating motions: when the ball (3) is in the open position and the piston (6) is in the closed position (FIGS. 3 and 5) the water is suctioned through the lower portion of the device (arrow F) along with the dirt having possibly gathered on the swimming pool bottom and walls.

Figure 2:
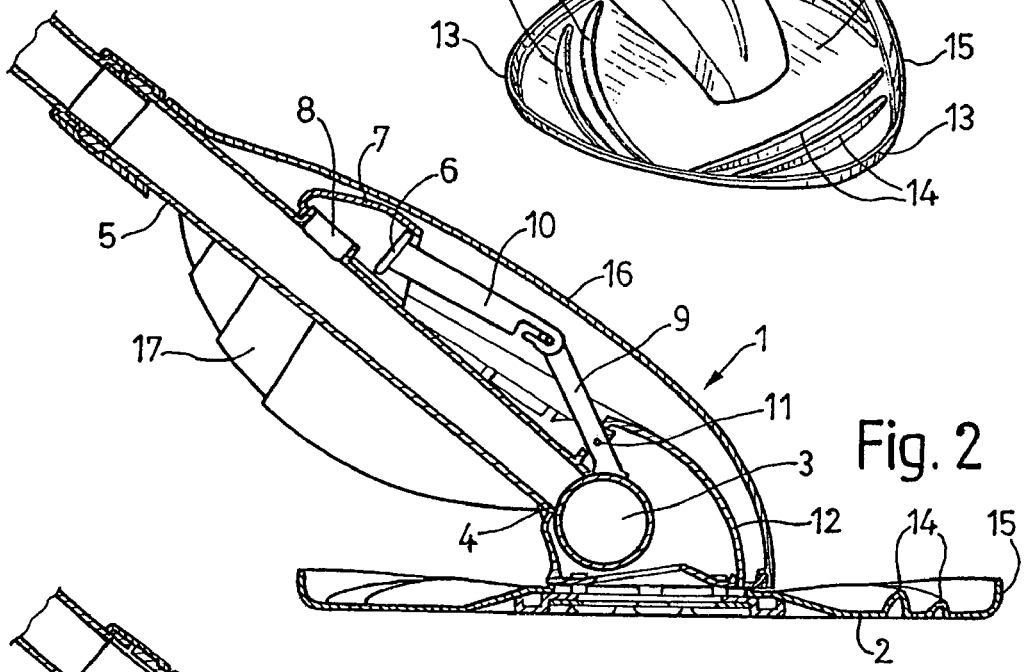
FIGS. 2 and 3 in a longitudinal section represent the aforementioned cleaning head and respectively show the obturation being produced by means of the ball and by means of the piston.

The very suction of the pump draws the ball (3) towards the inlet open end (4) of the main pipe (5) (FIGS. 2 and 4). This motion is mechanically interlinked with the piston (6) through the shaft (9, 10), this motion simultaneously causing the aforementioned piston (6) to assume the open position, the water being hence suctioned through the secondary pipe being formed by the tubular attachment (7) (arrow F').

The arrangement thereupon regains the former positions (FIGS. 3 and 5) because of the fact that the piston (6) is suctioned by the Venturi arrangement till fully reaching its closed position, the ball (3) at the same time regaining its open position with the pump suctioning the swimming pool water and dirt.

This continuous and simultaneous motion of the ball (3) and the piston (6) is what makes the cleaning device to randomly move across the whole swimming pool irrespective of this latter's shape, as a consequence of the jerks being produced by said closing and opening motions.

In order to prevent the ball (3) from being damaged or even possibly broken said ball has been provided in a freely movable and rotatable arrangement.

The makeup of the deflector being formed by the base (2) contributes to the suctioning and traveling action being carried out by the device. Its generally triangular shape combined with its freely turning movability makes it easier for the device to clear the obstacles being possibly present in the swimming pool, such as corners, ladders, projectors, etc., thus preventing the device from getting trapped or suffering time losses during idle time periods with no cleaning activity. Also the folds (14) and the presence of the peripheral skirt (15) contribute to that.

The invention claimed is:

1. A swimming pool bottom cleaning device comprising a cleaning head fitted with an alternately suctioning valve arrangement and provided with an elastic sliding base being freely rotatable in its plane, wherein the valve arrangement comprises a freely moving, ball-shaped valve member and a valve member formed by a piston with a Venturi arrangement, wherein the ball-shaped valve member and the piston are related to each other by an articulated shaft and are fit to alternately act on a main pipe and on a tubular attachment laterally connected to the main pipe, respectively.

2. A swimming pool bottom cleaning device as per claim 1, wherein the sliding base has an upwardly extending skirt provided around its periphery.

3. A swimming pool bottom cleaning device comprising a cleaning head fitted with an alternately suctioning valve arrangement and provided with an elastic sliding base being freely rotatable in its plane, wherein the valve arrangement comprises a freely moving, ball-shaped valve member; wherein the sliding base has a generally triangular shape and transversal folds provided in corner regions.

* * * * *